United States Patent [19]

Corry

[11] 4,233,348

[45] Nov. 11, 1980

[54] IMITATION COAL AND METHOD OF MAKING SAME

[76] Inventor: Nigel A. Corry, 38 Arthog Rd., Hale, Cheshire, England

[21] Appl. No.: 26,948

[22] Filed: Apr. 4, 1979

[51] Int. Cl.[2] ..... B44F 9/00

[52] U.S. Cl. ..... 428/15; 156/61; 272/8 F; 428/384

[58] Field of Search ..... 428/15, 17, 18, 384; 431/125; 272/8 F, 15; 40/428; 44/1 R; 106/65, 69; 156/61

[56] References Cited

U.S. PATENT DOCUMENTS

| | | | |
|---|---|---|---|
| 697,941 | 4/1902 | Hewitt | 431/125 |
| 1,336,500 | 4/1920 | Berry | 272/15 X |
| 1,567,855 | 12/1925 | Meany et al. | 272/15 X |
| 1,604,850 | 10/1926 | Payne | 272/15 X |
| 1,808,780 | 6/1931 | Logan | 428/15 |
| 3,377,229 | 4/1968 | Bryan | 428/15 X |
| 4,076,490 | 2/1978 | Hilker | 428/18 X |
| 4,110,063 | 8/1978 | Mitchell | 431/125 |

*Primary Examiner*—Henry F. Epstein
*Attorney, Agent, or Firm*—Ross, Ross & Flavin

[57] ABSTRACT

To make imitation coal elements, in the form of pellets or lumps which will glow and radiate heat effectively when heated by a gas flame in an open-type firegrate, use is made of raw ceramic bulk fibers. An appropriate mass thereof is moistened with a stiffening agent such as potato starch and is then squeezed to shape it into its pellet or lump shape and to express any excess stiffening agent; then it is baked to set the stiffening agent and fix the shape of the pellet or lump. Thereafter the element is colored by use of a black metallic oxide/colloidal sodium silicate impregnant which is applied twice in successive dipping and baking operations.

7 Claims, 9 Drawing Figures

IMITATION COAL AND METHOD OF MAKING SAME

BACKGROUND OF THE INVENTION

This invention concerns imitation coal.

The use of imitation coal pellets or lumps in open domestic firegrates is well known. A heap of the pellets or lumps is arranged in the firegrate, and gas flames are played thereon from below. The gas flames not only heat the imitation coal pellets and lumps, so that the latter radiate heat, but also flicker above the pellets or lumps and contribute significantly to achieving the appearance of a traditional open-grate coal fire.

In the known proposals, the imitation coal pellets or lumps have generally been of cement and/or concrete. Therefore, they are heavy. Furthermore, they have a substantial heat-absorbing capacity, and take up a considerable amount of heat before reaching a temperature at which their radiation is perceptible. However, adequate radiation has rarely been achievable, and open-grated fireplaces employing such imitation coal pellets or lumps have generally been regarded as being of decorative utillity rather than being effective heating appliances.

OBJECT OF THE INVENTION

An object of the invention is to provide a method of producing an imitation coal pellet or lump wherein the above-discussed disadvantages are obviated, the product being light in weight, having a low heat absorbency, and being capable of readily being brought to red heat so that it will radiate heat effectively.

BRIEF STATEMENT OF THE INVENTION

The present invention achieves the aforementioned object by providing a method of producing an imitation coal element, in the form of a lump, which comprises the step of moistening a mass of raw ceramic bulk fibres with a heat-settable stiffening agent, squeezing the resultant moistened mass to shape it into its desired coal lump shape and to express any excess stiffening agent, baking the moistened mass to set it into its lump shape, applying a black colouring by a two-stage process consisting of impregnating the shaped mass with a black metallic oxide/colloidal sodium silicate impregnant and baking the mass in two successive impregnating and baking operations.

The stiffening agent may be a cold water-potato starch dispersion or any commercially-available ceramic regidiser.

Baking of the stiffening-agent-impregnated mass may conveniently be effected at a temperature in the range of 200° C. to 300° C., preferably 250° C., for a suitable period of time, for instance from 20 to 30 hours, conveniently 25 hours.

The black metallic oxide/colloidal sodium silicate impregnant may conveniently comprise its metallic oxide and silicate components in the ratio of 2 to 1 by volume. These components may conveniently be formed into a cold water mix in the ratios of metallic oxide: silicate: water of 4:2:94 by volume.

In each baking operaton of the oxide/silicate impregnant, the baking is preferably carried out at a temperature in the range 200° C. to 300° C. (conveniently of rhe order of 250° C.) for an appropriate period as before in the range of 20 to 30 hours (conveniently 25 hours).

BRIEF DESCRIPTION OF THE DRAWINGS

The invention will be described further, by way of example, with reference to the accompanying drawings, in which.

DESCRIPTION OF THE PREFERRED EMBODIMENT

Figure 1:
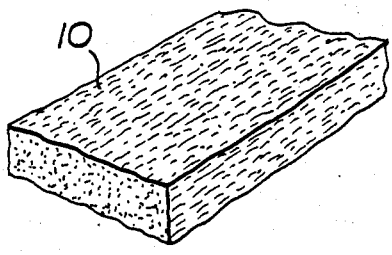
FIG. 1 is a fragmentary perspective view of a raw ceramic fibre mass which forms the starting material in carrying out the method of the invention.

Referring firstly to FIG. 1, this illustrates, very diagrammatically, the basic starting material or feedstock from which the product of the invention is made. It comprises a mass or lap 10 of raw ceramic bulk fibres. These fibres are available, in the form of loosely felted mats, batts or the like, of appearance, for example of cotton wool, for use as insulating materials, e.g. for lagging, domestic or industrial heat insulating and so on, for example from the Carborundum Company under the trade designation of FIBERFRAX.

Figure 2:
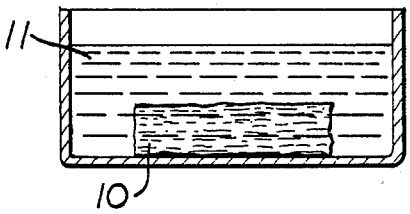
FIG. 2 is a diagrammatic sectional end view, showing the fibre mass of FIG. 1 in the course of being moistened.

As a first step in making an imitation coal element conforming to the invention, an appropriate amount of the mass or lap 10 is taken and, as shown diagrammatically in FIG. 2, is impregnated with a liquid stiffening agent 11. This agent 11 may, for instance, be a potato starch dispersion, or a commercially-available ceramic rigidiser. Where potato starch is employed, the dispersion may conveniently comprise potato starch and water in the ratio 1 part of potato starch in finely powdered form to 24 parts of water, the parts being by volume. This ratio can, if desired, be varied, of course, for instance in the range from 1 part of potato starch to 49 parts of water, to 1 part of potato starch to 12 parts of water, the parts again being by volume. The water may be cold.

Figure 3:
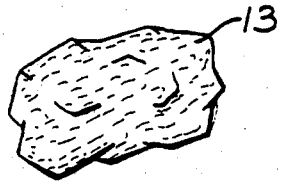
FIG. 3 illustrates the impregnated fibre mass of FIG. 2 having been squeezed into its desired shape and so as to express therefrom any excess stiffening agent.
Figure 4:
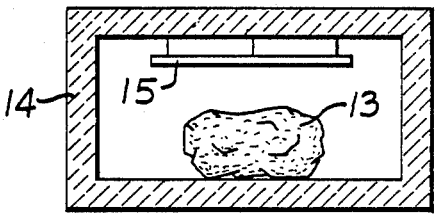
FIG. 4 illustrates the shaped mass from FIG. 3 being baked to set the stiffening agent and fix the shape of the pellet or lump defined by the impregnated mass.

The impregnaton having been effected, the fibre mass is squeezed and shaped, e.g. by hand, to form it into a shape, illustrated at 13 in FIG. 3, conforming to a coal pellet or lump, the squeezing or shaping serving, at the same time, to express any excess stiffening agent. Thereupon, the pellet or lump 13 is transferred into an oven 14 (FIG. 4) wherein it is baked, for example by means of a radiant element 15, at a temperature in the range of 200°

C. to 300° C., preferably about 250° C., to set the stiffening agent, for a period of 20 to 30 hours. The pellet or lump as subsequently taken from the oven 14 is set in its shape or configuration conforming to the desired imitation coal pellet or lump shape. The rigidity of the product is sufficient for its shape not to be significantly affected by usual handling, although of course its shape can be changed by the application of relatively strong forces, e.g. upon strong compression.

Figure 5:
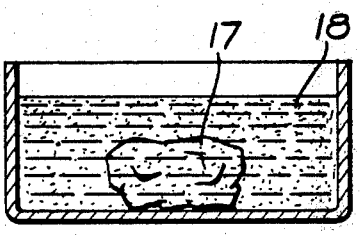
FIG. 5 is a diagrammatic sectional end view illustrating the set pellet or lump being subjected to a first impregnation with a colouring material.
Figure 6:
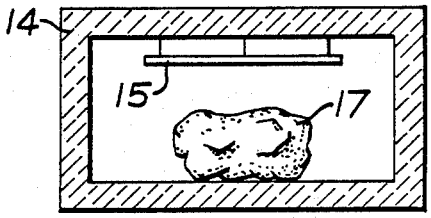
FIG. 6 is a view similar to FIG. 5 but illustrating the pellet or lump being baked to render permanent the first impregnation of colouring.

The semi-prepared product so far achieved is now coloured to resemble coal in a two-stage colouring process step. In the first stage, the stiffened product, now indicated at 17 in FIG. 5, is firstly impregnated with a liquid colouring medium 18 consisting of an inorganic metal oxide dispersed in a setting fluid, for example a colloidal sodium silicate. The proportion of metal oxide to silicate may be, for instance, in the range of ratios from 4 to 1 to 1 to 1, preferably approximately 2 to 1, and these constituents may be contained in water, optimum ratios of the oxide to silicate to water being approximately 4:2:94 the ratios being by volume. The water may be cold. The inorganic metal oxide may be that commercially available under the designation WG 659/B (inorganic black iron oxide) from Ferro Limited, and the silicate may be that commercially available, under the designation NALFLOC (a sodium silicate dispersion in water), from Imperial Chemical Industries Limited. As shown in FIG. 6, the product 17 is then baked to fix the colouring, at a temperature in the range 200° C. to 300° C., preferably 250° C., as above discussed, for a period of 20 to 30 hours. This baking can, if desired, be effected in the same oven 14.

Figure 7:
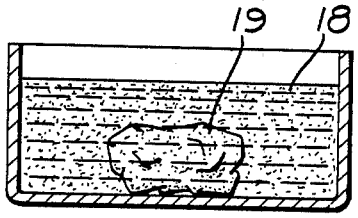
FIG. 7 is a view similar to FIG. 5, but illustrating the set pellet or lump being subjected to a second impregnation with a colouring material.
Figure 8:
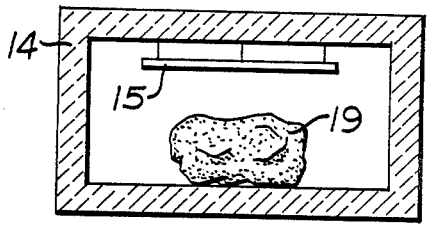
FIG. 8 is a view similar to FIG. 6, but illustrating the pellet or lump being baked to render permanent the second impregnation of colouring.

The colouring stage just described is then repeated for a second time, this being effected in precisely the same way as described in the foregoing, so that, as shown in FIG. 7, the pre-coloured product 19 is again impregnated with the liquid colouring medium 18, and is subsequently baked again as shown in FIG. 8.

The resultant product is an imitation coal pellet or lump of configuration corresponding to what is illustrated in FIG. 3 of the drawings and which is matt black in colour. It is light in weight, so that, after cooling, relatively large quantities thereof can be handled and carried (e.g. in the manufacture, storage and distribution of the product) relatively easily.

Figure 9:
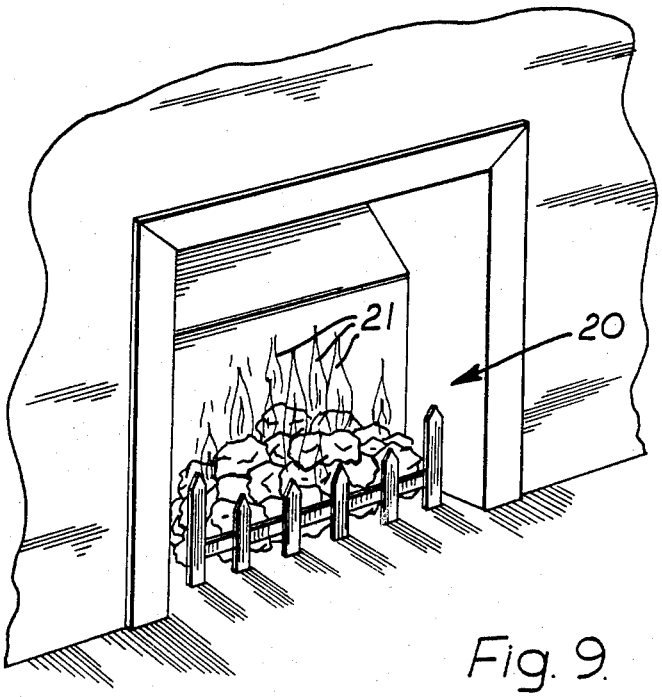
FIG. 9 is a diagrammatic perspective view illustrating a plurality of the imitation coal pellets or lumps in an open-grate fire.

As shown in FIG. 9, the artifical coal pellets or lumps 19 are used in an open basket-type domestic firegrate, indicated generally by the numeral 20, a quantity thereof being heaped up in the firegrate in the same way as one would with ordinary coals, as shown. The fireplace 20 incorporates one or more gas jets (not visible) which when ignited serve to permit flames 21 to play upwards on and also to emerge above the heap of coal pellets or lumps. Since the pellets or lumps are particularly light, they do not absorb any substantial heat. The outer surfaces thereof readily and rapidly reach red heat and the pellets or lumps are accordingly instrumental in radiating heat. As a result, the entire firegrate 20, instead of performing a primarily decorative function as has been the case with prior comparable proposals, is highly effective and performs an efficient heating function not hitherto possible using artificial or imitation coal products.

I claim:

1. An imitation coal element comprising: a raw ceramic bulk fibre mass which has been moistened with a heat-settable stiffening agent, squeezed into its desired coal lump shape and baked to set it into the desired shape of lump which has subsequently been coloured black by a two-stage colouring process each stage of which consists in impregnating the shaped mass with a black metallic oxide/colloidal sodium silicate impregnant and then baking the impregnated mass.

2. A method of producing an imitation coal element in the form of a lump which comprises the steps of: moistening a mass of raw ceramic bulk fibres with a heat-settable stiffening agent in the form of a ceramic rigidiser, shaping the resultant moistened mass into a desired coal lump shape and expressing therefrom the excess stiffening agent, setting the moistened mass into its lump shape by baking, applying a first and a second treatment of black metallic oxide/colloidal sodium silicate impregnant and baking the mass after each treatment.

3. The method as set forth in claim 2, the stiffening agent being a cold water-potato starch dispersion.

4. The method as set forth in claim 3, the baking of the moistened mass being effected at a temperature in the range 200° to 300° C. for a period of 20 to 30 hours.

5. The method as set forth in claim 2, the metallic oxide/colloidal sodium silicate impregnant comprising oxide and silicate in the ratio 2:1 by volume.

6. The method as set forth in claim 5, the metallic oxide/colloidal sodium silicate impregnant being a cold water mix comprising oxide, silicate and water in the ratios 4:2:94 by volume.

7. The method as set forth in claim 6, the baking of the oxide/silicate impregnant being carried out at a temperature in the range 200 to 300° C. for a period from 20 to 30 hours.

* * * * *